United States Patent [19]

Sillars

[11] Patent Number: 4,911,073

[45] Date of Patent: Mar. 27, 1990

[54] METHOD AND APPARATUS FOR SINGLE CHARACTER PRINTING USING ENDLESS BELT PRINTERS

[76] Inventor: Ian M. Sillars, 2704 The Strand, Manhattan Beach, Calif. 90266

[21] Appl. No.: 225,096

[22] Filed: Jul. 27, 1988

[51] Int. Cl.[4] ..... B41F 5/18

[52] U.S. Cl. ..... 101/181; 101/375; 101/DIG. 48; 101/92

[58] Field of Search ..... 101/74, 73, 72, 76, 101/91, 92, 375, 376, 377, DIG. 48, 181

[56] References Cited

U.S. PATENT DOCUMENTS

| | | | |
|---|---|---|---|
| 710,380 | 9/1902 | Turck | 101/76 |
| 3,119,327 | 1/1964 | Pidgeon | 101/376 X |
| 3,295,443 | 1/1967 | Devon | 101/376 |
| 3,329,088 | 7/1967 | Rockefeller, Jr. | 101/DIG. 48 |
| 3,537,394 | 11/1970 | Swapp | 101/376 X |
| 3,577,918 | 5/1971 | Wayfield | 101/74 X |
| 4,031,822 | 6/1977 | Wilson | 101/72 X |
| 4,538,516 | 9/1985 | Aaron | 101/376 X |
| 4,541,333 | 9/1985 | Sillars | 101/76 |
| 4,628,816 | 12/1986 | Six | 101/76 X |

*Primary Examiner*—Clifford D. Crowder
*Attorney, Agent, or Firm*—Hecker & Harriman

[57] ABSTRACT

A method and apparatus for printing a single image at a time in a flexographic printing environment. The present invention utilizes a flexographic plate cylinder which has been modified by forming a groove in its circumference. The groove extends partially around the circumference of the cylinder, leaving an area approximately equal to the area of a single flexographic plate. A belt having a plurality of flexographic plates mounted thereon is entrained about the printing cylinder coincident with the groove and raised area. The groove prevents transfer of the flexographic image to a film passing between the impression cylinder and printing cylinder. Only when the raised area is adjacent the impression cylinder will an image be transferred from a flexographic plate. In addition, only the plate over the raised area is inked when the flexographic belt passes an anilox inking roller. This prevents the accumulation of ink on plates that are not used for image transfer on a particular rotation of the belt. In the preferred embodiment of the present invention, a printing cylinder is utilized having a circumference equal to the printing repeat dimension of the package being printed. A flexographic belt having a prime number of printing plates (gradients) is entwined about the printing cylinder and an idle roller. The idle roller has a circumference which is a prime number of gradients less than that of the printing roller. In this manner, a different of the flexographic plates is disposed over the raised area of the printing cylinder and thus transferred to the film for each revolution of the printing cylinder.

17 Claims, 4 Drawing Sheets

METHOD AND APPARATUS FOR SINGLE CHARACTER PRINTING USING ENDLESS BELT PRINTERS

BACKGROUND OF THE PRESENT INVENTION

1. Field of the Present Invention

This invention relates to the field of flexographic printing.

2. Background Art

A large number of consumer products are packaged in what is referred to as "flexible packaging". In flexible packaging, indicia such as company logos, labels, product information etc, is printed on polypropylene, polyethylene, foil, paper film, paper, or other non-rigid material is processed through film presses known as "flexographic" presses. A flexographic press consists of a central impression cylinder which is driven by a drive mechanism of the press. A printing cylinder is disposed adjacent the impression cylinder. One or more printing plates may be mounted on the printing cylinder with each plate having an image formed thereon for transfer to the film.

During printing, the flexographic plates are inked by way of an anilox roller which is in turn inked from an inking roller. A printing film is threaded between the impression cylinder and the printing cylinder. As the printing cylinder rotates, the image of each flexographic plate is transferred to the printing film.

Many packaged goods firms desire to employ promotions as part of the packaging of a product. For, examples, discount coupons may be printed as part of the package to encourage repeat business. In other cases, a game may be integrated into the packaging to promote the purchase of the product. One method of incorporating such games into flexible packaging utilizes the printing of quasi random number tables as part of a lottery type game and is described in U.S. Pat. Nos. 4,541,333 and 4,601,239 and in the U.S. patent application Ser. Nos. 133,666; 142,155; 160,267; and, 164,579.

In certain embodiments of the above referenced patents and patent applications, printing stations utilizing a flexographic belt arrangement for transferring images are described. An endless belt is entrained around the printing cylinder and also around an idle roller spaced from the printing cylinder. In some embodiments a tension roller may also be provided to tension the belt about the printing and idle rollers.

The belt is typically a non-elastic nylon belt having internal teeth on the inner surface of the belt which are engaged with gear teeth on the printing cylinder to keep the belt always in register with the motion of the printing cylinder. The outer surface of the belt is provided with a plurality of flexographic printing plates which are adhered to the nylon belt at a predetermined basic pitch value or gradient.

Another type of promotion which is often desired to be used in flexible packaging is the printing of the likeness of a popular character, celebrity or athlete onto the package, making it a collectible item and thereby encouraging the purchase of the product. In such promotions, it is desired to print a plurality of different likenesses on the product so that a consumer is encouraged to purchase multiple units of the product. Such a promotion requires the manufacturer to be able to print a changing image on each package. However, in the prior art methods of flexographic printing, the printing of a changing image is not possible.

One prior art method of printing a changing image is to make a number of different printing "runs" in which a different character is printed during each run. However, this method has the disadvantage of requiring a large amount of downtime while plates on the printing cylinder are changed. Another method comprises providing a custom printing cylinder with a number of plates mounted thereon, each representing a different image. However, this requires that the gradients of the plates be the same size as the repeat dimension of the package being printed. As a result, the printing cylinder would must be very large to hold even a small number of image plates. In many applications, the available space for a printing cylinder is fixed, limiting the number of different images that could be printed using the prior art method. Also, if the number of desired images were changed, a new printing cylinder must be provided. This adds to the expense of the system.

Therefore, it is an object of the present invention to provide a method of printing a changing image in a flexographic printing environment.

It is another object of the present invention to provide method and apparatus for printing of a single plate image at a time which is gradient independent.

It is yet another object of the present invention to provide a method and apparatus for inking a single plate image at a time which is gradient independent.

It is still another object of the present invention to provide a method and apparatus for printing changing images in two or more colors in registration.

SUMMARY OF THE PRESENT INVENTION

The present invention is directed to a method and apparatus for printing a single image at a time in a flexographic printing environment. The present invention utilizes a flexographic plate cylinder which has been modified by forming a groove in its circumference. The groove extends partially around the circumference of the cylinder, leaving an area approximately equal to the area of a single flexographic plate. A belt having a plurality of flexographic plates mounted thereon is entrained about the printing cylinder coincident with the groove and raised area. The groove prevents transfer of the flexographic image to a film passing between the impression cylinder and printing cylinder. Only when the raised area is adjacent the impression cylinder will an image be transferred from a flexographic plate. In addition, only the plate over the raised area is inked when the flexographic belt passes an anilox inking roller. This prevents the accumulation of ink on plates that are not used for image transfer on a particular rotation of the belt.

In the preferred embodiment of the present invention, a printing cylinder is utilized having a circumference equal to the printing repeat dimension of the package being printed. A flexographic belt having a prime number of printing plates (gradients) is entwined about the printing cylinder and an idle roller. The idle roller has a circumference which is a prime number of gradients less than that of the printing roller. In this manner, a different of the flexographic plates is disposed over the raised area of the printing cylinder and thus transferred to the film for each revolution of the printing cylinder.

BRIEF DESCRIPTION OF THE DRAWINGS

FIG. 3 is a side view of one stage of operation of the present invention.

DETAILED DESCRIPTION OF THE PRESENT INVENTION

The present invention is directed to a method and apparatus for printing a single character at a time onto a flexible package. In the following description, numerous specific details, such as number of gradients, number of belts, etc, are set forth in order to provide a more thorough description of the present invention. It will be apparent, however, to one skilled in the art, that the present invention may be practiced without these specific details. In other instances, well known features have not been described in detail in order not to unnecessarily obscure the present invention.

The preferred embodiment of the present invention consists of a printing cylinder having a groove formed thereon and partially extending about the circumference of the printing cylinder, leaving a raised portion at one location. The printing cylinder is used in a flexographic printing system used for printing of flexible packaging. A flexographic belt is disposed about the printing cylinder and an idle roller. The belt contains a number of different flexographic printing plates, each containing the image of a different character or image to be transferred to a package. The number of flexographic plates on the belt is preferably equal to a prime number such as, for example, 13. As the belt rotates, a different one of the plates is positioned over the raised area of the printing cylinder for each revolution of the cylinder. Only that plate transfers its image to the printing film on that particular revolution. The circumference of the printing cylinder is equal to the printing area of the package to be printed so that for each rotation of the printing cylinder only one plate of the belt is presented to the package film for printing.

For a flexographic belt having N flexographic plates attached thereto, a total of N revolutions of the printing cylinder is required before any pattern is repeated. In one embodiment of the present invention, a belt having 13 plates, each having a different image formed thereon, is utilized. A different of the plates is printed for each of the first 13 revolutions of the printing cylinder.

Figure 1:
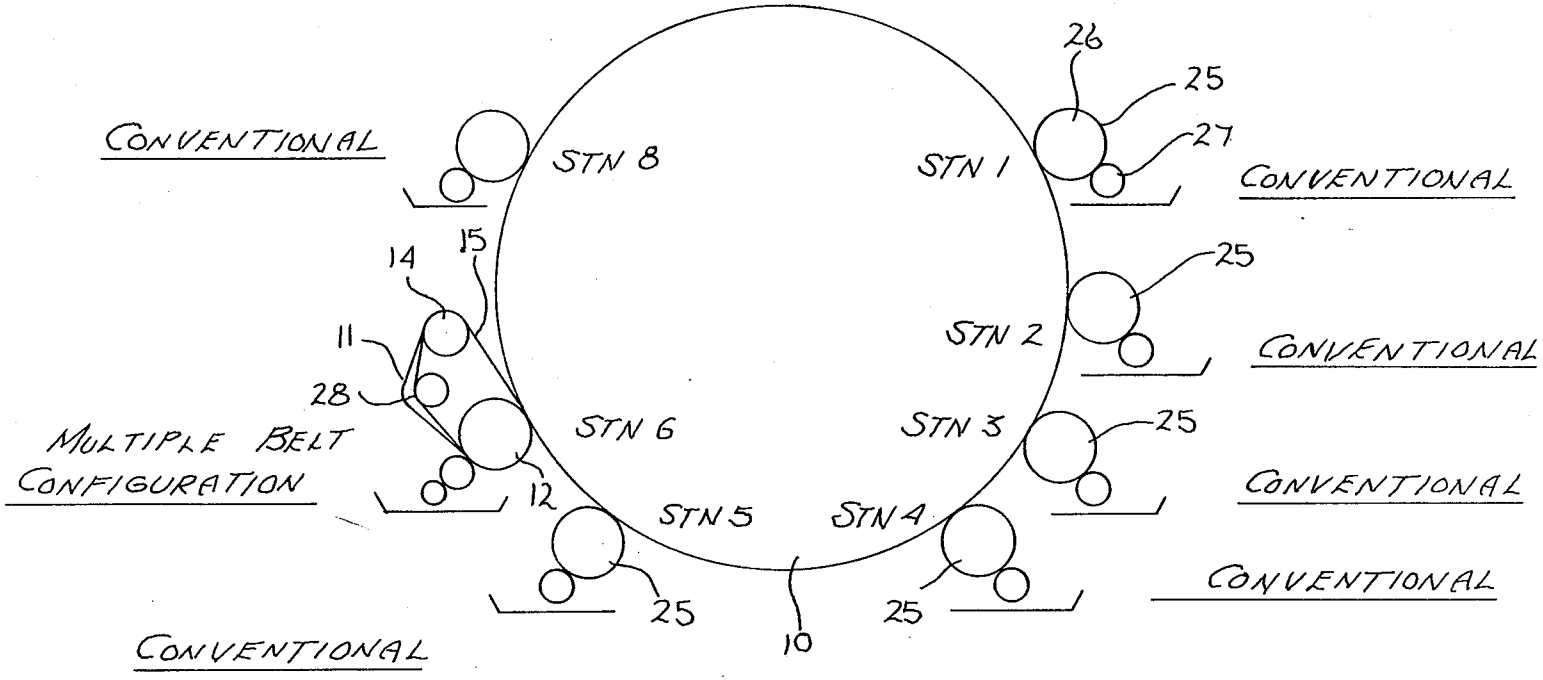
FIG. 1 is a side view of a flexographic printing press.

A flexographic printing press such as may be used with the present invention is illustrated in FIG. 1. The press consists of a central impression cylinder 10, surrounded by one or more conventional printing stations 25. The conventional printing stations comprise a printing cylinder 26 having image plates coupled thereto. The printing cylinders are inked by an anilox roller 27. Alternatively, a belt type station 11 may be utilized in which the printing station 11 comprises a printing cylinder 12, a flexographic belt 13, and an idle roller 14. Optionally, a tension roller 28 may be employed to provide tension to the belt 13.

Printing film such as paper, polypropylene, polyethylene, foil, film, paper, or other non-rigid material is entwined about the central impression cylinder such that it passes between the central impression cylinder and the printing cylinder of the printing station. The flexographic belt has formed thereon a number of flexographic plates 16. Each plate contains an image to be transferred to the printing film. In the preferred embodiment, each plate contains a different image, such as a celebrity or licensed character. However, any combination of images, from a single image on all plates to two or more images repeated on a number of plates, may be utilized with the present invention. Regardless of the images on the plates, only a single plate is printed at a time with the present invention.

Figure 2:
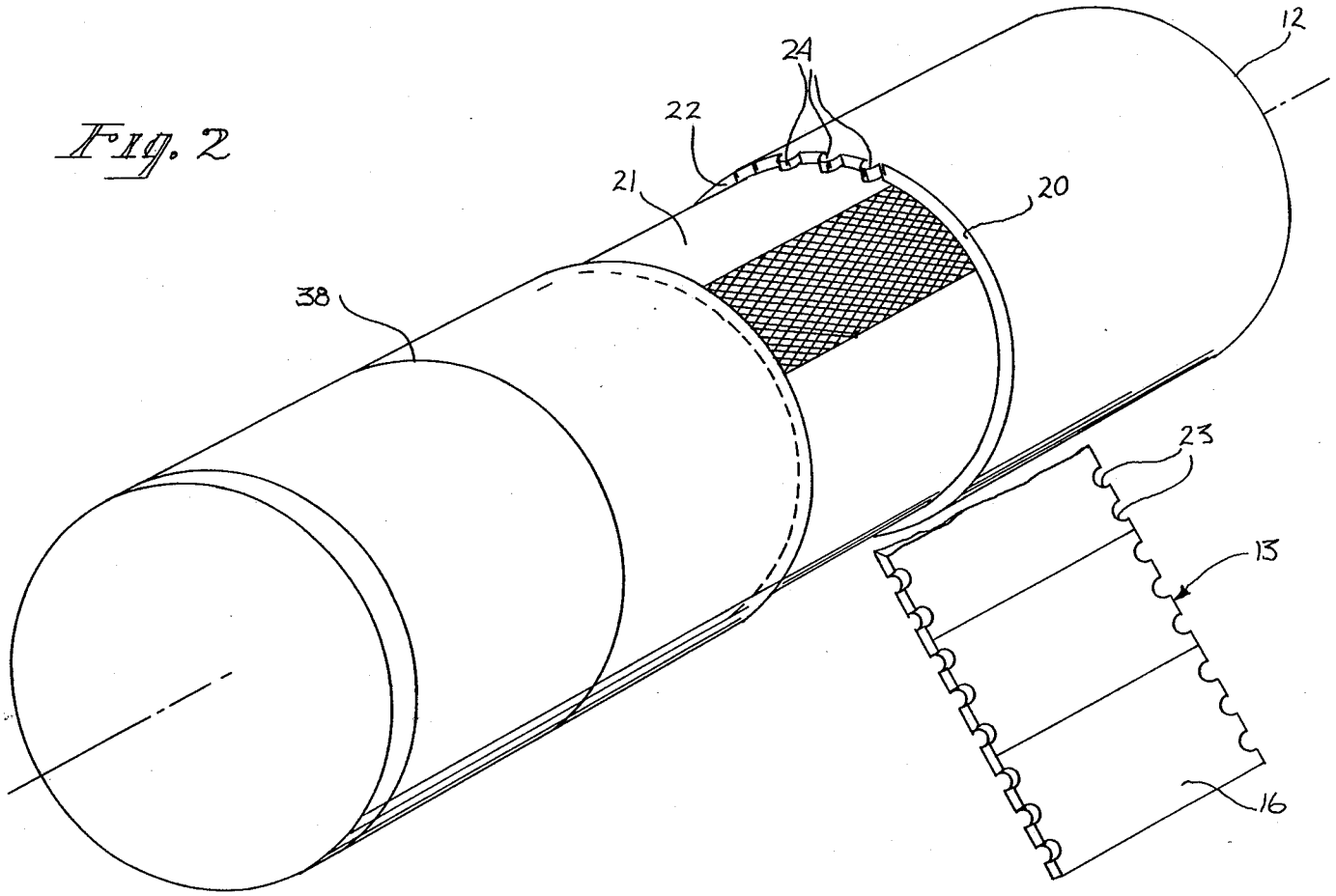
FIG. 2 is a perspective view of the printing cylinder of the present invention.

A perspective view of a printing cylinder of the preferred embodiment is illustrated in FIG. 2. The printing cylinder 12 comprises an elongated cylinder having a groove 21 formed nearly circumferentially about the cylinder 12. It should be noted that the cylinder of FIG. 2 is illustrated in a representational manner and is not drawn to scale. In the preferred embodiment of the present invention, the raised area 20 is approximately the same dimension as a flexographic printing plate.

The groove 21 does not extend completely about the cylinder 12 but terminates part way around, leaving a raised portion 20 substantially flush with the surface of the remainder of the cylinder 12. The raised portion 20 provides a support surface for a flexographic plate so that when the raised portion rotates past the central impression cylinder, the image on the flexographic plate currently over the raised portion is transferred to the film.

The groove 21 creates a side wall 22 defining the depth of the groove 21. The depth of the groove in the preferred embodiment approximates the thickness of a flexographic belt and plate. In this manner, when a plate positioned over the groove 21 rotates past the central impression cylinder, the plate is back away from the printing film so that no image is transferred. In the preferred embodiment, the circumference of the printing cylinder 12 is such that it is equal to the repeat dimension of the package being printed. Therefore, only a single image is transferred to each package each revolution of the printing cylinder.

The dimensions of the groove are substantially equal to the width and thickness of the flexographic belt to be utilized with the printing roller 12. The groove must be wide enough to completely receive the portion of the flexographic belt not positioned over the raised are 20. Gear teeth 24 are provided in the side wall 22 of the groove to engage indents in the flexographic belt, such as indents 23. In this manner, the flexographic belt maintains registration with the printing roller 12.

Figure 4:
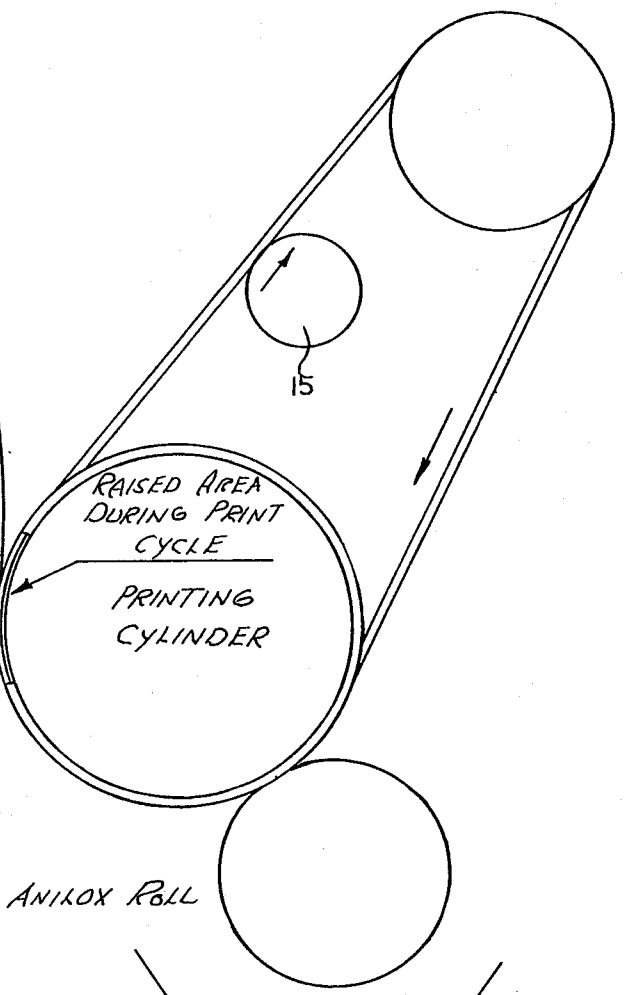
FIG. 4 is a side view of a second stage of operation of the present invention.

The operation of the present invention is illustrated in FIGS. 3 and 4. Referring first to FIG. 3, a side view of the present invention in operation as part of a printing station is shown. The printing cylinder 12 is disposed adjacent and substantially abutting central impression cylinder 10. An anilox roller 18 is positioned away from the central impression cylinder 10 and adjacent the printing cylinder 12. An ink font is disposed beneath the anilox roller 18 to provide a supply of ink to the anilox roller 18.

A flexographic belt 13 is entwined about the printing cylinder 12 and an idle roller 14. The flexographic belt 13 is disposed about the printing roller 12 so as to be coincident with the groove 21 (see FIG. 2). The flexographic belt 13 includes a plurality of flexographic plates mounted on the outside thereof for transferring images to a printing film 17 threaded between the central impression cylinder 10 and the flexographic belt 13.

The flexographic belt 13, in the preferred embodiment of the present invention, includes a prime number of image plates or gradients. For example, in FIGS. 3 and 4, the belt includes 13 plates. The diameter of the idle roller 14 is such that as the belt rotates, a different of the flexographic plates is over the raised area 20 for each revolution of the printing cylinder 12. With a 13 gradient flexographic belt 13, the printing order (the order in which the plates appear over the raised area 20), is as follows:

13
7
b 1
8
2
9
3
10
4
11
5
12
6

Therefore, after 13 revolutions of the printing cylinder 12, all 13 of the plates are presented to the printing film 17, one each revolution. Although the present invention is described in terms of a flexographic belt having a prime number of gradients, the present invention is not limited to prime numbers. Any number of gradients can be utilized with the method and apparatus of the present invention.

In operation, the flexographic belt 13 rotates in the opposite direction of the central impression cylinder 10. For example, if the central impression cylinder turns counter clockwise, the printing cylinder and flexographic belt turn clockwise. When the arrangement is as shown in FIGS. 3 and 4, it is preferred that the flexographic belt rotate in a clockwise direction. During operation, a flexographic plate disposed over the raised area contacts the anilox roller 18 as shown in FIG. 3. The anilox roller 18 picks up ink from the ink font 19 and transfers it to the image on the plate. When a plate not disposed over the raised area 20 passes the anilox roller, no ink is transferred to the plate because it is recessed into the groove and cannot contact the anilox roller 18. Because only the plate which is to be printed is inked, dried ink build-up is avoided on the flexographic belt.

Further, the clockwise rotation of the printing cylinder results in the shortest travel path of the inked flexographic plate to avoid drying of the ink. As shown in FIG. 3, the inked plate travels less than half the circumference of the printing roller 12 after contact with the inking roller 18. If the travel of the flexographic belt were counterclockwise, the inked plate would have to travel the length of the belt, resulting in unacceptable ink drying and variable travel times depending on the length of the belt. The present invention results in the shortest travel path for the inked plate and is independent of the length of the flexographic belt.

Referring now to FIG. 4, the raised area 20 of the printing cylinder 12 is shown adjacent the central impression cylinder 10. At this stage of the printing process, the flexographic plate positioned over the raised area 20 abuts the printing film 17 at the impression cylinder 10. The printing cylinder 12 presses the plate against the film and impression cylinder, causing the image of the plate to be transferred to the film. Due to the groove 21 in the printing cylinder, no other images are transferred to the film until a complete rotation of the raised area 20 has occurred. At that time, a different plate is positioned over the raised area, so that a different image is transferred. In addition, only a single plate's image is printed at a time with the present invention.

Although only a single printing station utilizing the present invention is shown in FIGS. 3 and 4, a number of stations employing the present invention my be provided. By positioning the stations one package repeat distance apart, images in different colors and in registration may be printed on a package. In addition to the flexographic belt, conventional printing plates can be mounted on either side of the groove to print unchanging indicia on the package if desired, (for example, plate 38 of FIG. 2).

Although shown in use with a central impression cylinder type of flexographic press, the present invention can be used with a rotogravure press by replacing one of the rotor stations with a flexographic station such as shown in FIGS. 3 and 4. Further, the printing station can be used as a stand alone unit or with any type of printing operation and applications.

Figure 5:
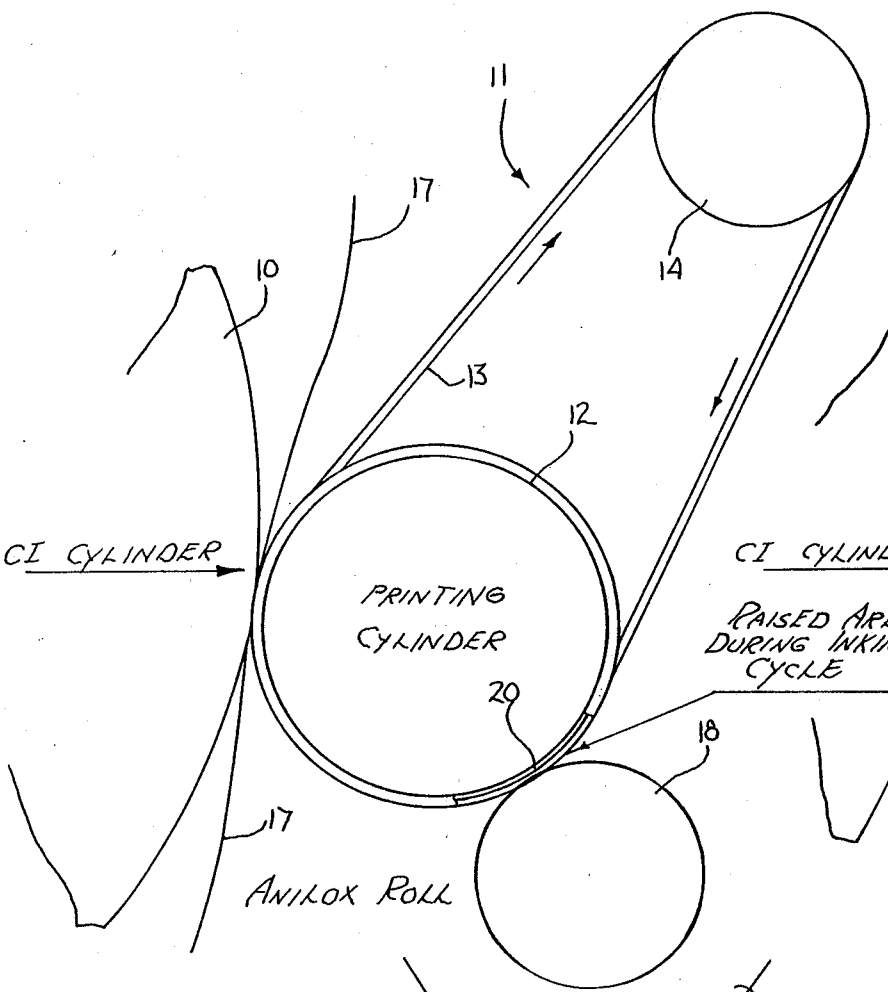
FIG. 5 is a perspective view of an alternate embodiment of the present invention in which a plurality of belts of different lengths are entwined about a single printing cylinder.
Figure 5:
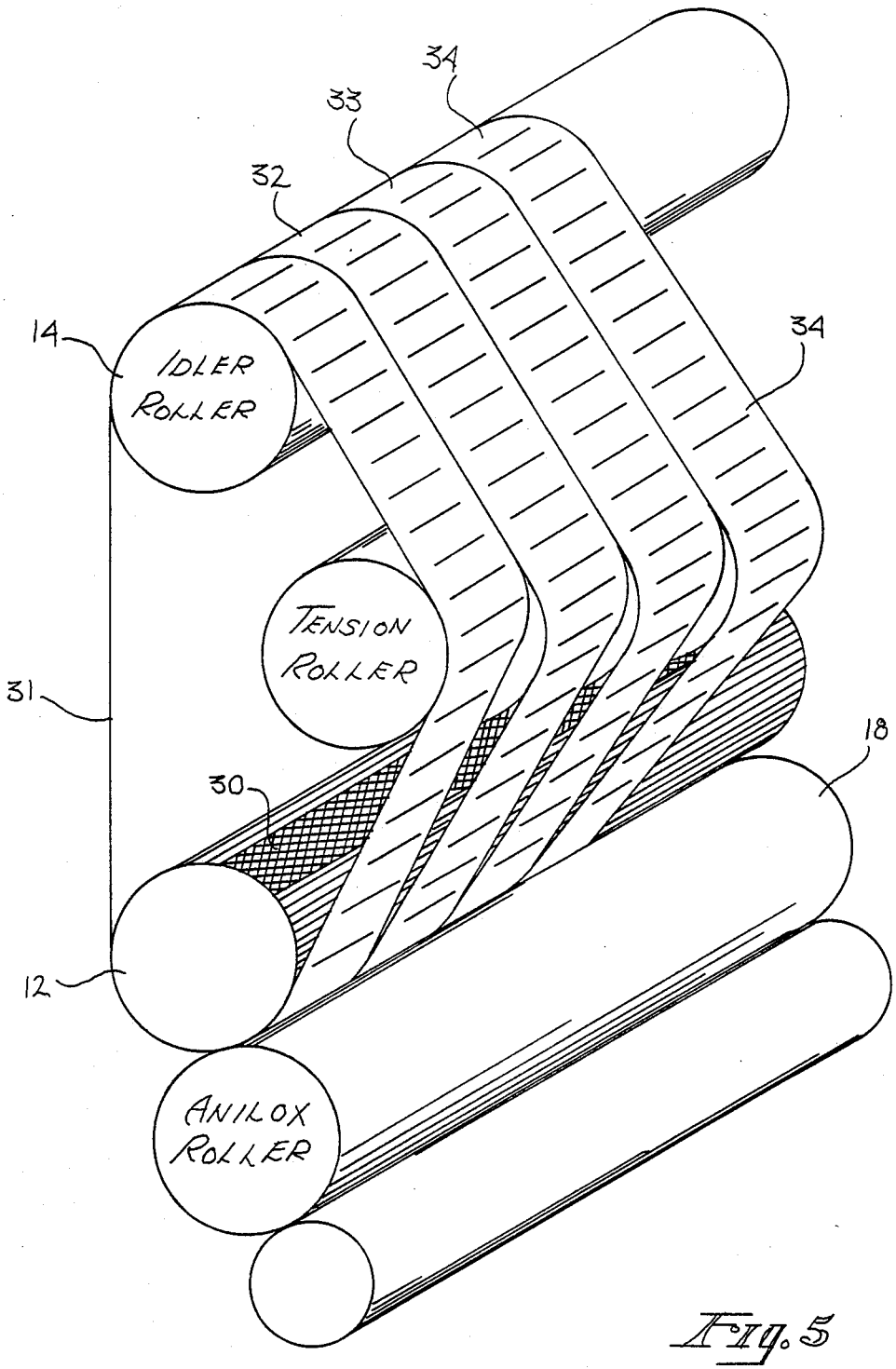

An alternate embodiment of the present invention is illustrated in FIG. 5. In this application, a raised area 30 extends approximately the length of the printing cylinder 12. A number of flexographic belts are entwined about the printing cylinder and an idle roller. Each belt is also entwined about an associated tension roller. The belts are each a different length and in one version of this alternate embodiment, are each a different prime multiple of a basic pitch value.

The length of the belts are selected so that if the belts are in a first relationship to one another at a first point and time, it will take a large number of rotations of each belt before this relationship is repeated. For each revolution of the longest belt 31, each of the other belts rotate greater than one revolution. In one possible application, each plate of each belt contains the image of a portion of a bar code to be printed on a flexible package. Because there are a large number of possible combinations due to the varied rotation rates of the individual belts, a large number of quasi random bar code representations may be printed using the present invention.

As with the single belt application, inking and printing occurs only for those plates positioned over the raised area of the printing cylinder 12. This makes the configuration particularly useful for printing a large number of image combinations without repeat while utilizing a fixed circumference printing cylinder 12. Although the present invention contemplates each belt being a prime multiple of a basic pitch value, any ratio of the belts may be utilized if desired.

Thus, a method and apparatus for single character printing has been described.

I claim:

1. An apparatus for printing of images onto a film comprising:

a central impression roller;

a first printing cylinder disposed adjacent to said impression roller, a first belt entwined about said printing cylinder and a first idle roller disposed away from said first printing cylinder and said impression roller;

said first belt having a plurality of plates coupled thereto, each of said plates having an image formed thereon;

inking means disposed adjacent said first belt for providing ink to said plates on said first belt;

said first printing cylinder having a groove formed therein and extending partially about the circumference of said first printing cylinder, said groove terminating in a raised area having a surface substantially coincident with a surface of said first printing cylinder;

said first belt disposed substantially coincident with said groove so that said belt is recessed into said groove and only one of said plates is disposed over said raised area.

2. The apparatus of claim 1 wherein said first belt comprises a flexographic belt.

3. The apparatus of claim 1 wherein said plurality of plates comprise a number which is a prime gradient of the circumference of said first printing cylinder.

4. The apparatus of claim 3 wherein said circumference of said first printing cylinder is substantially equal to a repeat rate of a package printed on said apparatus.

5. The apparatus of claim 1 further including a plurality of second belts of different lengths entwined about said first printing cylinder and said idle roller, each of said second belts having an associated tension roller for maintaining the tension of each of said belts.

6. The apparatus of claim 1 further including at least a second printing cylinder disposed adjacent said impression cylinder and having a second belt entwined about said second printing cylinder and a second idle roller.

7. A printing roller for use in a printing station having at least one flexographic belt entwined about said printing cylinder comprising:

a cylindrical member having a circumferential groove formed thereon, said groove extending partially about a circumference of said printing cylinder and terminating at a raised printing area of said printing cylinder, said groove substantially equal in width to said flexographic belt.

8. The roller of claim 7 wherein said raised area is substantially equal to the area of a flexographic printing plate disposed on said flexographic belt.

9. The roller of claim 7 further including at least one printing plate formed on said cylinder adjacent said groove of said cylinder.

10. The cylinder of claim 7 wherein said roller is a flexographic printing roller.

11. A method for printing one of a plurality of images on a package comprising the steps of:

providing a central impression cylinder;

providing a first printing cylinder adjacent said impression cylinder;

forming a groove partially around a circumference of said first printing cylinder and terminating said groove at a raised area substantially coincident with a surface of said first printing cylinder;

providing an idle roller spaced away from said first printing cylinder and said impression cylinder;

entwining a belt about said first printing cylinder and said idle roller, said belt having a plurality of plates mounted thereto, said plates being substantially of the same dimensions as said raised area of said first printing cylinder;

providing a first color of ink to one of said plates disposed over said raised area of said first printing cylinder;

rotating said impression cylinder in a first direction and said first printing cylinder in a second direction such that a plate over said raised area abuts said impression cylinder once each revolution of said cylinder;

providing a film between said impression cylinder and said first printing cylinder for receiving images from said plate disposed over said raised area of said first printing cylinder.

12. The method of claim 11 wherein said plurality of plates comprises a number which is equal a prime gradient of said circumference of said first printing cylinder.

13. The method of claim 11 further including the step of providing one of said plurality of printing plates adjacent said groove of said first printing cylinder.

14. The method of claim 11 further including the steps of:

providing a second printing cylinder having a groove formed thereon;

providing a second belt entwined about said second printing cylinder;

providing a second color of ink to said plates of said second printing cylinder;

consecutively printing images from said first and second belts on said film.

15. The method of claim 11 wherein said first printing cylinder has a circumference approximately equal to a repeat dimension of a package to be printed.

16. The method of claim 11 wherein said groove includes teeth formed therein for engaging indents formed in said first belt.

17. The method of claim 11 further including a tension roller disposed within and abutting said first belt and spaced apart from said first printing cylinder and said idle roller.

* * * * *